US011371465B2

(12) United States Patent
Kageyama et al.

(10) Patent No.: US 11,371,465 B2
(45) Date of Patent: Jun. 28, 2022

(54) CYLINDER HEAD AND ENGINE

(71) Applicant: Komatsu Ltd., Tokyo (JP)

(72) Inventors: Yuuki Kageyama, Tokyo (JP); Shouhei Nagasaka, Tokyo (JP)

(73) Assignee: Komatsu Ltd., Tokyo (JP)

( * ) Notice: Subject to any disclaimer, the term of this patent is extended or adjusted under 35 U.S.C. 154(b) by 657 days.

(21) Appl. No.: 16/323,280

(22) PCT Filed: Oct. 29, 2018

(86) PCT No.: PCT/JP2018/040081
§ 371 (c)(1),
(2) Date: Feb. 5, 2019

(87) PCT Pub. No.: WO2019/050052
PCT Pub. Date: Mar. 14, 2019

(65) Prior Publication Data

US 2021/0348579 A1 Nov. 11, 2021

(51) Int. Cl.

| | |
|---|---|
| ***F02F 1/36*** | (2006.01) |
| ***F02F 1/42*** | (2006.01) |
| ***F02F 1/26*** | (2006.01) |
| ***F02F 1/24*** | (2006.01) |

(52) U.S. Cl.
CPC ..... *F02F 1/36* (2013.01); *F02F 1/24* (2013.01); *F02F 1/26* (2013.01); *F02F 1/4285* (2013.01)

(58) Field of Classification Search
CPC .... F02F 1/36; F02F 1/4285; F02F 1/26; F02F 1/24; F03F 1/40
USPC ..... 123/41.01
See application file for complete search history.

(56) References Cited

U.S. PATENT DOCUMENTS

| | | | | |
|---|---|---|---|---|
| 4,660,527 | A | 4/1987 | Tanaka et al. | |
| 5,743,218 | A * | 4/1998 | Aupperle | F02F 1/38 123/193.5 |
| 2006/0016404 | A1* | 1/2006 | Paul | F02F 1/242 123/41.82 R |
| 2009/0255490 | A1 | 10/2009 | Poschl et al. | |
| 2013/0340703 | A1* | 12/2013 | Jones | F02F 1/24 123/193.5 |

(Continued)

FOREIGN PATENT DOCUMENTS

| | | | |
|---|---|---|---|
| CN | 1356455 | A | 7/2002 |
| CN | 103452690 | A | 12/2013 |
| CN | 106662033 | A | 5/2017 |

(Continued)

*Primary Examiner* — Yi-Kai Wang
(74) *Attorney, Agent, or Firm* — Locke Lord LLP

(57) ABSTRACT

The cylinder head 3 includes: a lower deck; a wall portion including an upper deck and a lower deck; an upper deck that is provided above the lower deck so as to face the lower deck and that defines a cooling water flow space between the lower deck and the upper deck; and a wall portion that is formed between the lower deck and the upper deck and includes a valve-hole forming wall 40 forming an intake valve hole and an exhaust valve hole which are opened into a lower surface of the lower deck. The lower deck includes: a cooling water introduction hole that passes through the lower deck in a vertical direction so as to extend in a circumferential direction of a virtual circle VC surrounding a valve-hole forming wall in a plan view; and a rib that projects from an upper surface of the lower deck.

18 Claims, 6 Drawing Sheets

(56) References Cited

U.S. PATENT DOCUMENTS

| | | | | |
|---|---|---|---|---|
| 2015/0211408 | A1* | 7/2015 | Maier | F02F 1/38<br>123/41.77 |
| 2018/0030920 | A1* | 2/2018 | Wicks | F02F 7/0085 |

FOREIGN PATENT DOCUMENTS

| | | | |
|---|---|---|---|
| DE | 10251360 | A1 | 5/2004 |
| JP | 60-124550 | U | 8/1985 |
| JP | 61-204944 | U | 12/1986 |
| JP | 02-063053 | U | 5/1990 |
| JP | 03-114558 | U | 11/1991 |
| JP | H07-071311 | A | 3/1995 |
| JP | 2008-075504 | A | 4/2008 |
| JP | 2008-082226 | A | 4/2008 |
| JP | 2012-012959 | A | 1/2012 |
| WO | 2015/098705 | A1 | 7/2015 |

* cited by examiner

CYLINDER HEAD AND ENGINE

TECHNICAL FIELD

The present invention relates to a cylinder head and an engine.

BACKGROUND TECHNOLOGY

Patent Document 1 discloses a cylinder head which is fixed to an upper portion of a cylinder block constituting an engine with a bolt and has a cooling water flow space (head jacket) inside the cylinder head. In such a cylinder head, a lower deck, which is located on the cylinder block side and defines a cooling flow space, is exposed to a high temperature. Therefore, it has been considered to efficiently cool down the lower deck by forming thin the lower deck.

In the cylinder head of Patent Document 1, ribs for reinforcing the lower deck are formed on the lower deck (lower wall) of the cylinder head which is located on the cylinder block side and defines the cooling flow space. In view of the flow of cooling water in the cooling water flow space, the rib extends from the valve-hole forming wall (intake port wall portion) corresponding to a predetermined cylinder in a cylinder arranged direction in which a plurality of cylinders arc arranged.

PRIOR ART DOCUMENT

Patent Document

Patent Document 1: Japanese Unexamined Patent Application Publication No. 2012-012959.

SUMMARY OF THE INVENTION

Problems to be Solved by the Invention

However, in the cylinder head of Patent Document 1, the ribs extend from the valve-hole forming wall in the radial direction of the cylinder. Therefore, the flow of the cooling water around the valve-hole forming wall is obstructed by the ribs. In this case, cooling of the valve-hole forming wall caused by the cooling water becomes insufficient.

The present invention is provided to solve the above problem, and the present invention provides a cylinder head in which the rigidity of a lower deck can be improved and which can efficiently cool a valve-hole forming wall by cooling water, and an engine provided therewith.

Means for Solving the Problem

A cylinder head according to a first aspect of the present invention includes: a lower deck; an upper deck that is provided above the lower deck so as to face the lower deck and that defines a cooling water flow space between the lower deck and the upper deck; a wall portion that is formed between the lower deck and the upper deck and includes a valve-hole forming wall forming an intake valve hole and an exhaust valve hole which arc opened into a lower surface of the lower deck. The lower deck includes: a cooling water introduction hole that passes through the lower deck in a vertical direction so as to extend in a circumferential direction of a virtual circle surrounding the valve-hole forming wall when seen from a plan view; and a rib that is provided to be arranged in the circumferential direction of the virtual circle with respect to the cooling water introduction hole and projects from an upper surface of the lower deck so as to extend in the circumferential direction.

The engine according to the first aspect of the present invention includes: the cylinder head; and a cylinder block having a cylinder bore forming a cylinder and covered by the cylinder head from above, wherein the virtual circle is a circle corresponding to a planar view shape of the cylinder bore.

Effect of Invention

According to the present invention, the rigidity of the lower deck of the cylinder head can be improved, and the valve-hole forming wall can be cooled efficiently by the cooling water.

MODE FOR CARRYING OUT THE INVENTION

Figure 1:
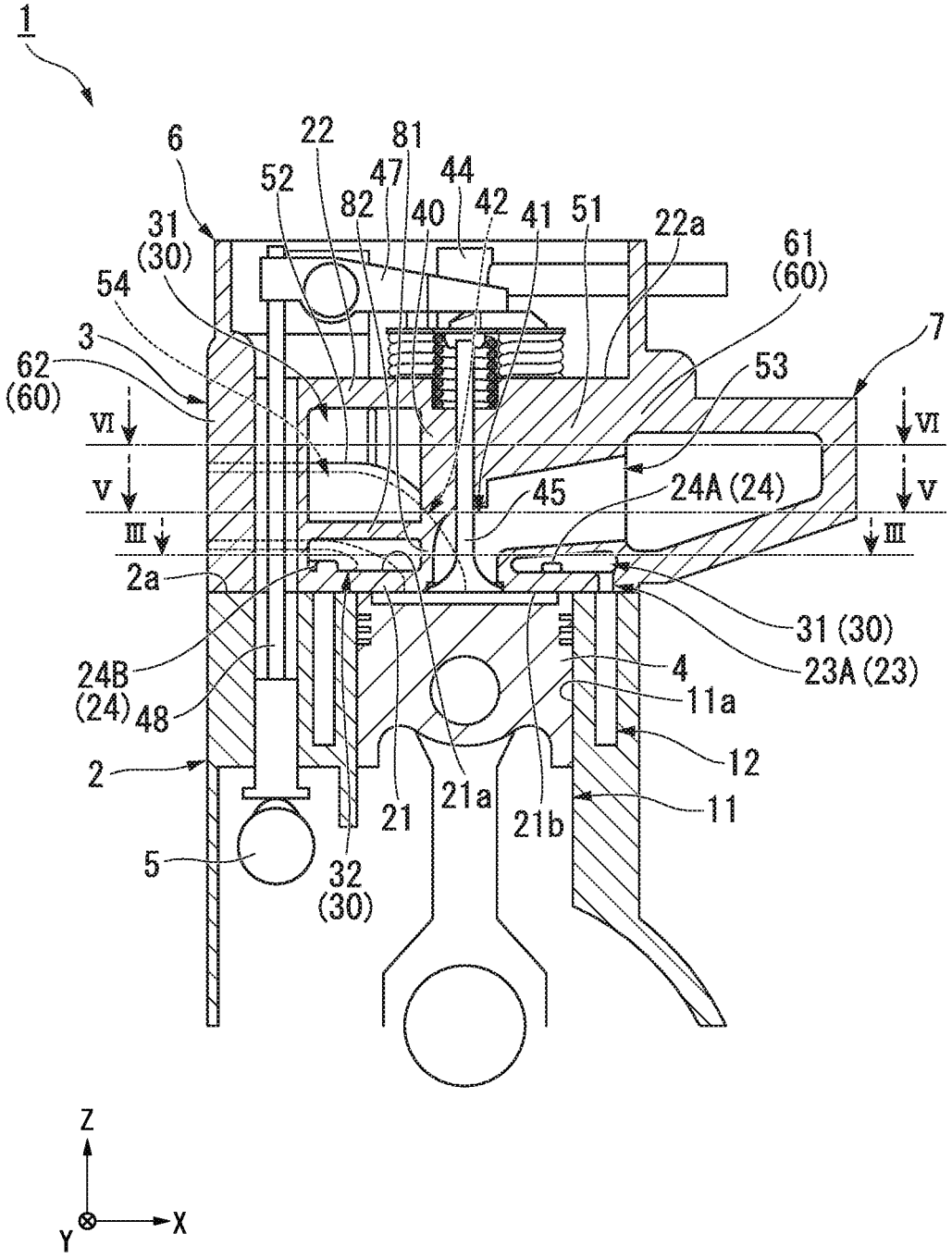
FIG. 1 is a cross-sectional view showing an engine including a cylinder head according to an embodiment of the present invention.

Hereinafter, an embodiment of the present invention will be described in detail with reference to FIG. 1 to FIG. 6. As shown in FIGS. 1 and 4, a cylinder head 3 according to the present embodiment constitutes an engine 1 together with a cylinder block 2. The engine 1 of the present embodiment is a diesel-engine.

In FIGS. 1 to 6, a direction in which the cylinder block 2 and the cylinder head 3 are arranged is defined as a Z-axis direction. Further, a first orthogonal direction orthogonal to the Z-axis direction is defined as a Y-axis direction. Further, a second orthogonal direction orthogonal to the Z-axis direction and the Y-axis direction is defined as an X-axis direction.

<Cylinder Block>

Figure 2:
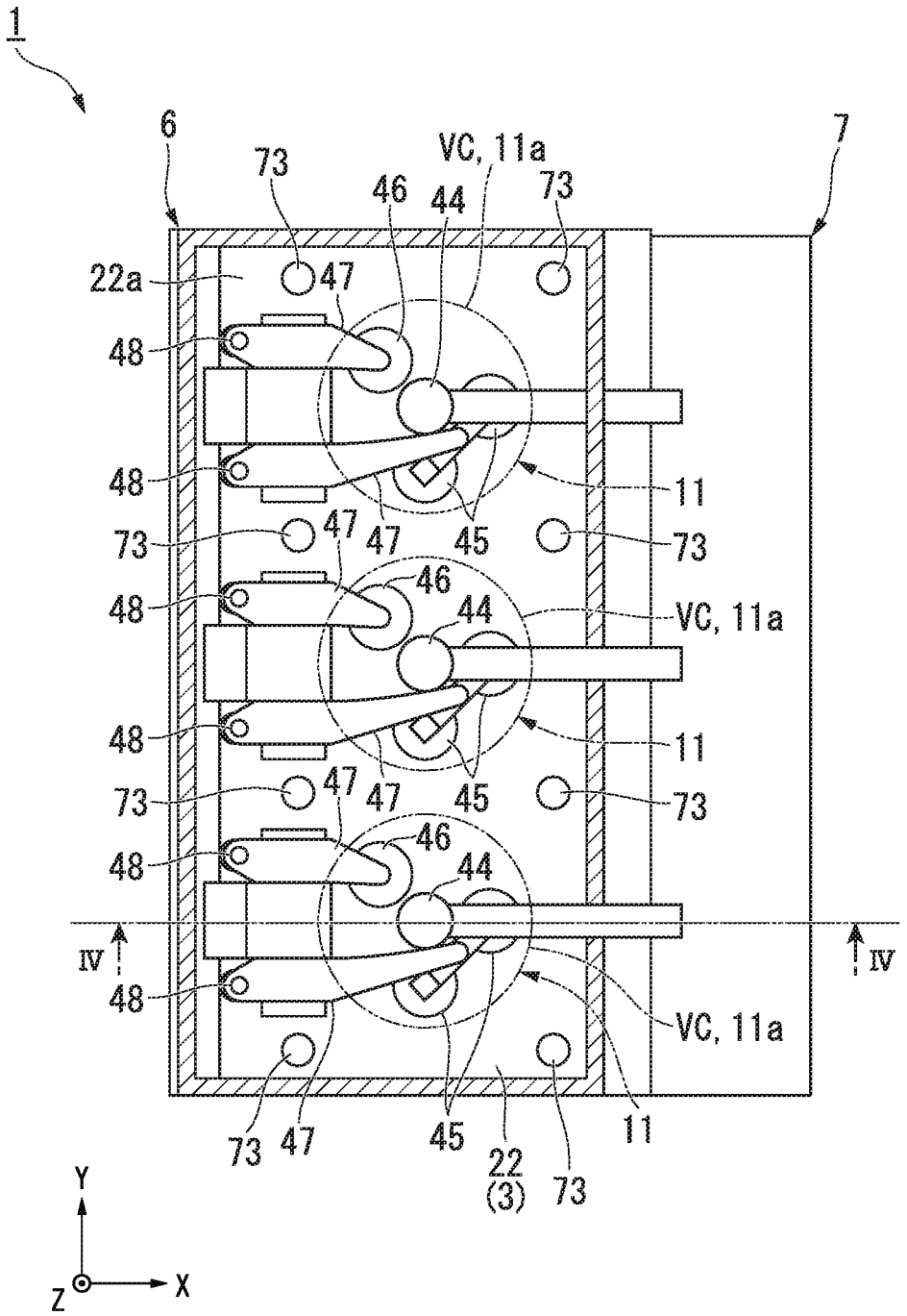
FIG. 2 is a top view of the engine of FIG. 1 when viewed from above.

As shown in FIGS. 1 and 4, the cylinder block 2 has a cylinder bore 11*a* which forms a cylinder 11. The cylinder 11 is a space in which the piston 4 (FIG. 1) is disposed. The cylinder 11 is opened into an upper surface 2*a* of the cylinder block 2. The piston 4 reciprocates in a vertical direction (Z-axis direction) by receiving a pressure of combustion gas that has been combusted in the cylinder 11. As shown in FIG. 2, the cylinder block 2 of the present embodiment includes a plurality of (three in the example shown in the drawings) cylinders 11. The plurality of cylinders 11 are aligned in a line in a first orthogonal direction (Y-axis direction) orthogonal to the vertical direction. In the following description, the first orthogonal direction in which a plurality of cylinders 11 are arranged is also referred to as a cylinder arranged direction.

As shown in FIGS. 1 and 4, a cooling water flow space 12 (hereinafter, referred to as a block-side flow space 12) surrounding each of the cylinder bores 11*a* is formed in the cylinder block 2. Cooling water that cools the cylinder bore 11*a* flows through the block-side flow space 12. The block-side flow space 12 opens into the upper surface 2*a* of the cylinder block 2.

As shown in FIG. 1, a cam shaft 5 for driving a rocker arm 47, which will be described later, is disposed inside the cylinder block 2. The cam shaft 5 extends in the cylinder arranged direction. The cam shaft 5 rotates in response to the reciprocating movement of the piston 4.

<Cylinder Head>

The cylinder head 3 is disposed to overlap with the upper surface 2*a* of the cylinder block 2 so as to cover an upper opening of the cylinder 11.

As shown in FIGS. 1 and 4, the cylinder head 3 includes a lower deck 21 and an upper deck 22. Each of the lower deck 21 and the upper deck 22 is formed in a shape of a plate. The lower deck 21 is a portion of the cylinder head 3, which is disposed to overlap with the upper surface 2*a* of the cylinder block 2. The upper deck 22 is provided above the lower deck 21 so as to face the lower deck 21. In other words, the lower deck 21 and the upper deck 22 are arranged at a distance from each other in the vertical direction (Z-axis direction). The upper deck 22 defines a cooling water flow space 30 (hereinafter, referred to as a "head-side flow space 30") between the lower deck 21 and the upper deck 22.

A cooling water introduction hole 23 is formed in the lower deck 21. The cooling water introduction hole 23 penetrates the lower deck 21 in its plate thickness direction (vertical direction). The cooling water introduction hole 23 connects the block-side flow space 12 of the cylinder block 2 and the head-side flow space 30 of the cylinder head 3. Further, on the lower deck 21, ribs 24 projecting from the upper surface 21*a* of the lower deck 21 which forms an inside surface of the head-side flow space 30 are formed. Details of the cooling water introduction hole 23 and the ribs 24 will be described later.

<Valve-Hole Forming Wall>

As shown in FIGS. 1, and 3 to 6, the cylinder head 3 includes a valve-hole forming wall 40 that extends from the lower deck 21 to the upper deck 22.

Figure 3:
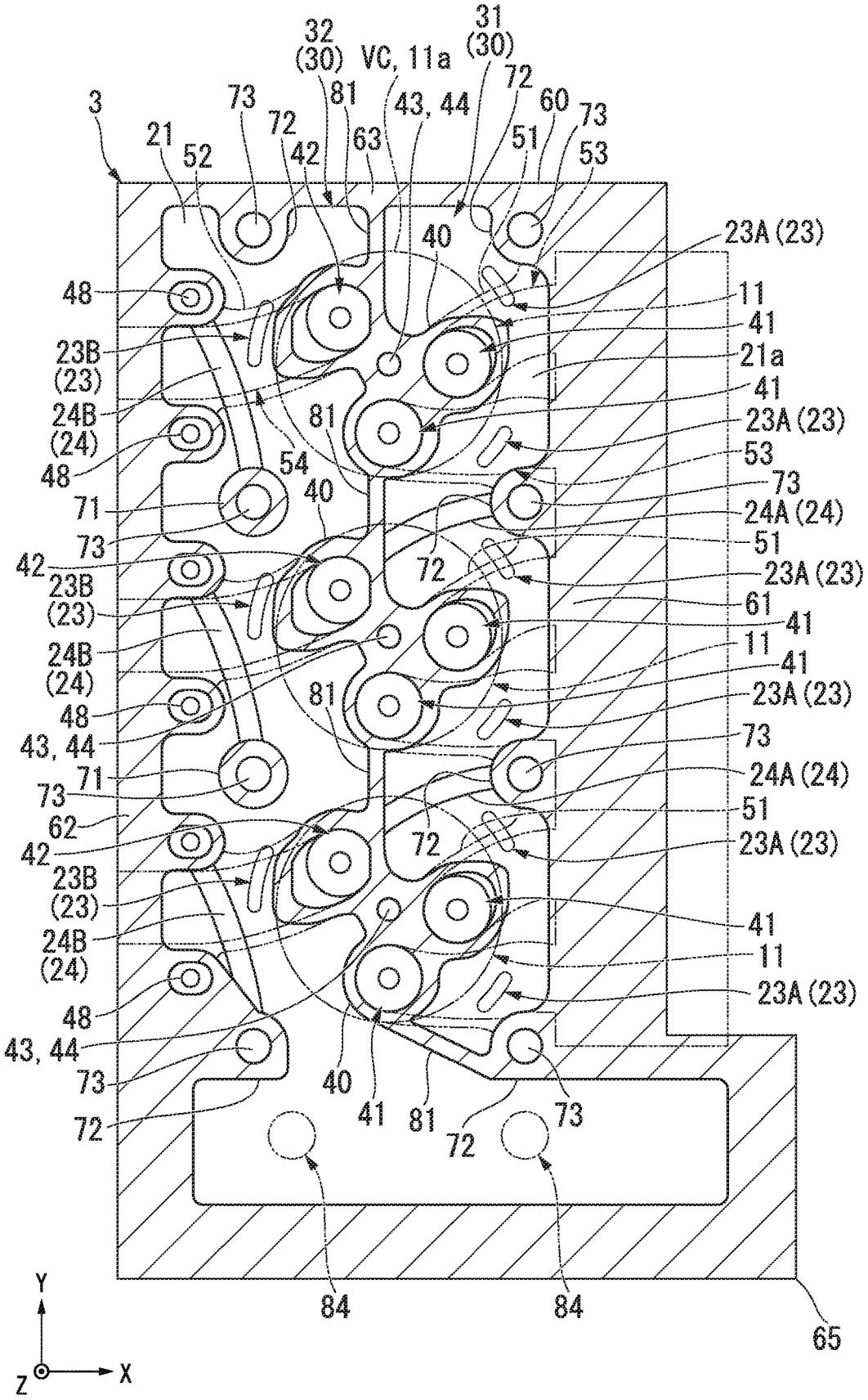
FIG. 3 is a cross-sectional view taken along the line III-III of FIG. 1.
Figure 4:
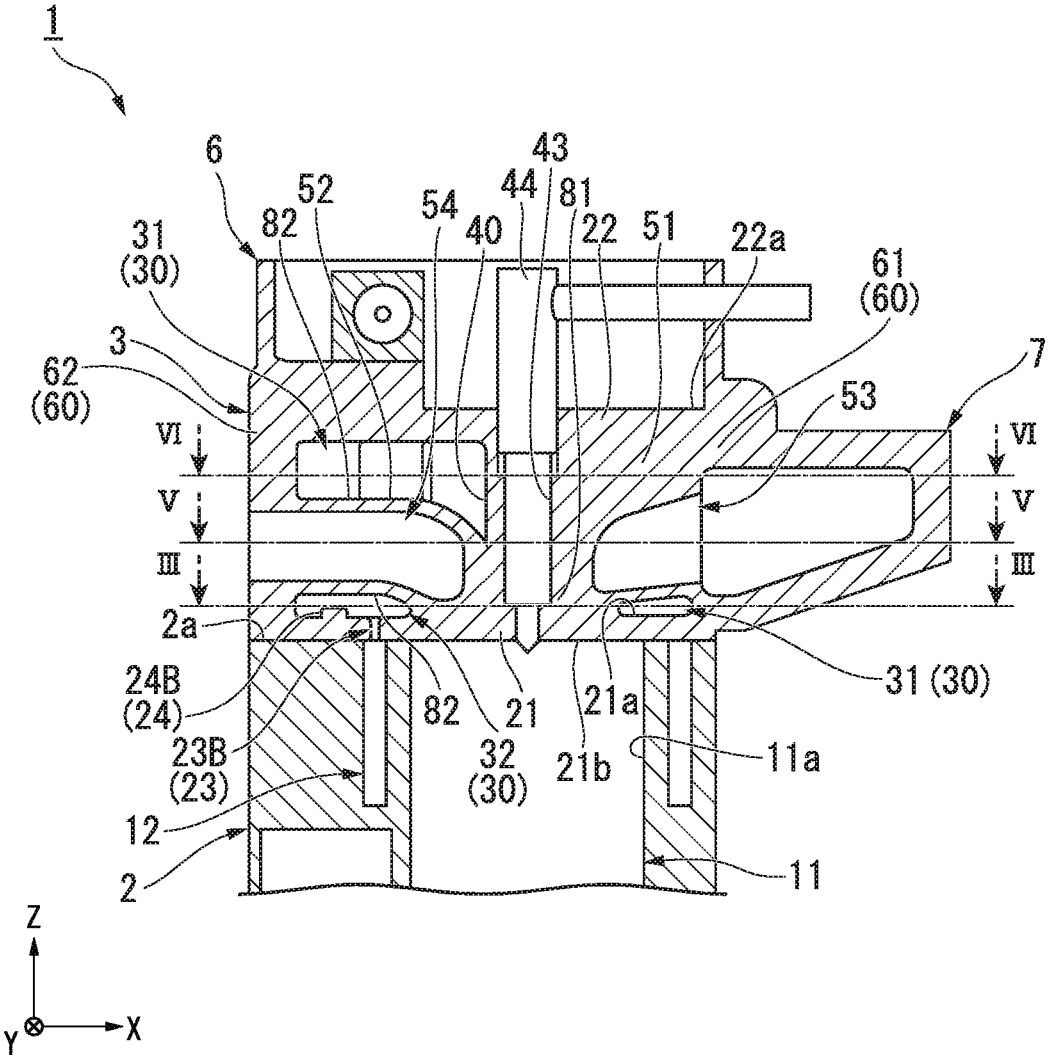
FIG. 4 is a cross-sectional view taken along the line IV-IV of FIG. 2.
Figure 5:
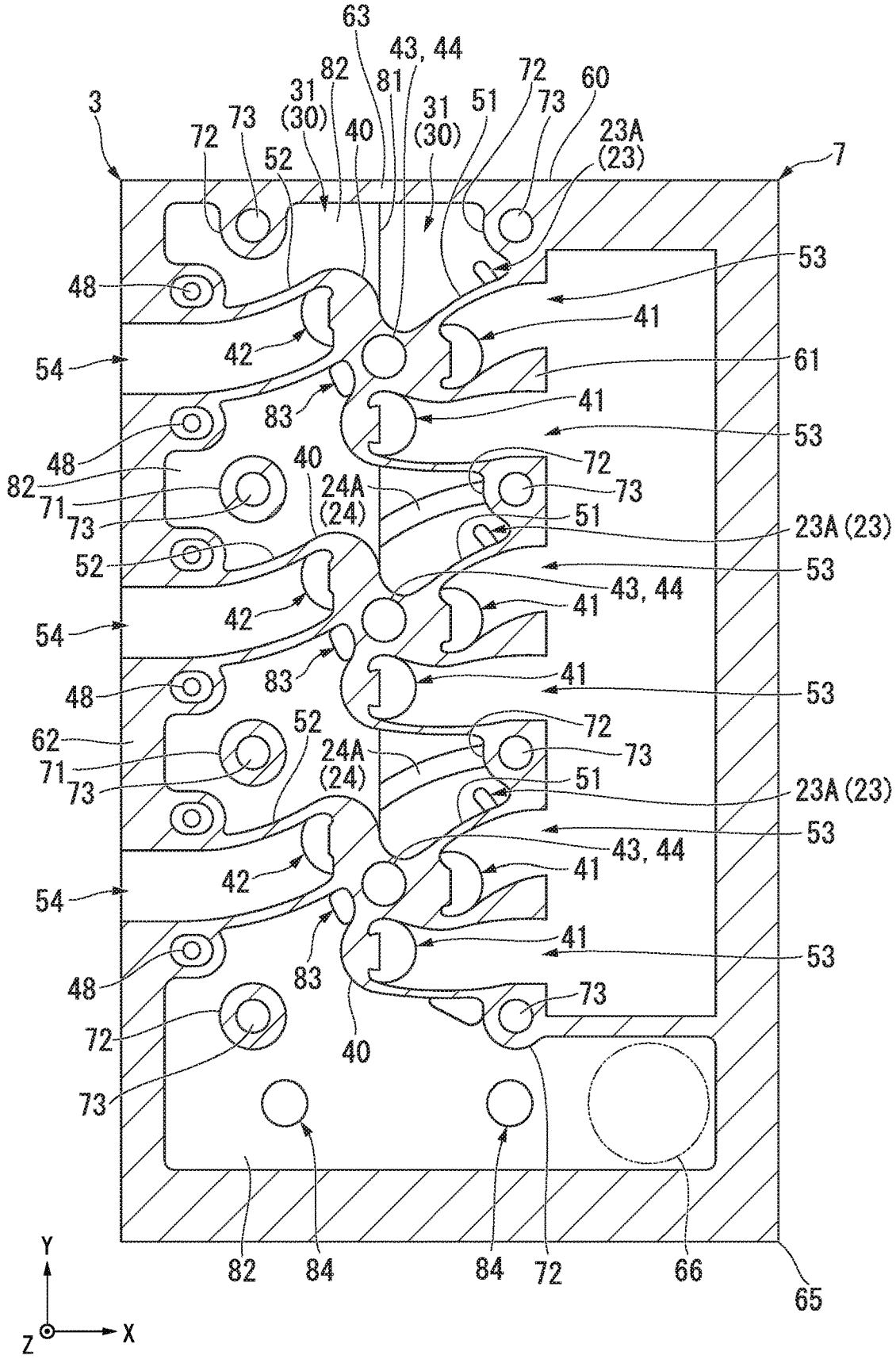
FIG. 5 is a cross-sectional view taken along the line V-V of FIG. 1 and FIG. 4.

As shown in FIGS. 1, 3, and 5, the valve-hole forming wall 40 is formed with an intake valve hole 41 and an exhaust valve hole 42 that open into the lower surface 21*b* of the lower deck 21. The lower surface 21*b* of the lower deck 21 is a surface facing the upper surface 2*a* of the cylinder block 2. The intake valve hole 41 and the exhaust valve hole 42 are formed in an lower end portion of the valve-hole forming wall 40 located on the lower deck 21 side. Each of the intake valve hole 41 and the exhaust valve hole 42 communicates with the cylinder 11 of the cylinder block 2.

As shown in FIGS. 3 to 6, a central hole 43 through which a fuel injector 44 (injector) is inserted in the vertical direction is formed in the valve-hole forming wall 40. The fuel injector 44 extends through the vertical direction of the cylinder head 3. In other words, the fuel injector 44 protrudes from the lower surface 21*b* of the lower deck 21 and from the upper surface 22*a* of the upper deck 22. As shown in FIGS. 3, and 5, the intake valve hole 41 and the exhaust valve hole 42 are arranged at a distance with each other around the central hole 43 in the circumferential direction.

As shown in FIGS. 1, and 2, the valve-hole forming wall 40 is provided with an intake valve 45 for opening and closing each of the intake valve holes 41 so as to be movable in the vertical direction. Part of the intake valve 45 protrudes from the upper surface 22*a* of the upper deck 22. In addition, in the same way as the intake valve 45, an exhaust valve 46 for opening and closing each of the exhaust valve holes 42 is provided in the valve-hole forming wall 40. The configuration and arrangement of the exhaust valve 46 are the same as those of the intake valve 45.

The intake valve 45 and the exhaust valve 46 are each driven by swinging the rocker arms 47 provided on the upper surface 22*a* of the upper deck 22. The rocker arm 47 swings by moving in the vertical direction the push rod 48 which penetrates through the cylinder head 3 in the vertical direction in accordance with the rotation of the cam shaft 5.

Figure 6:
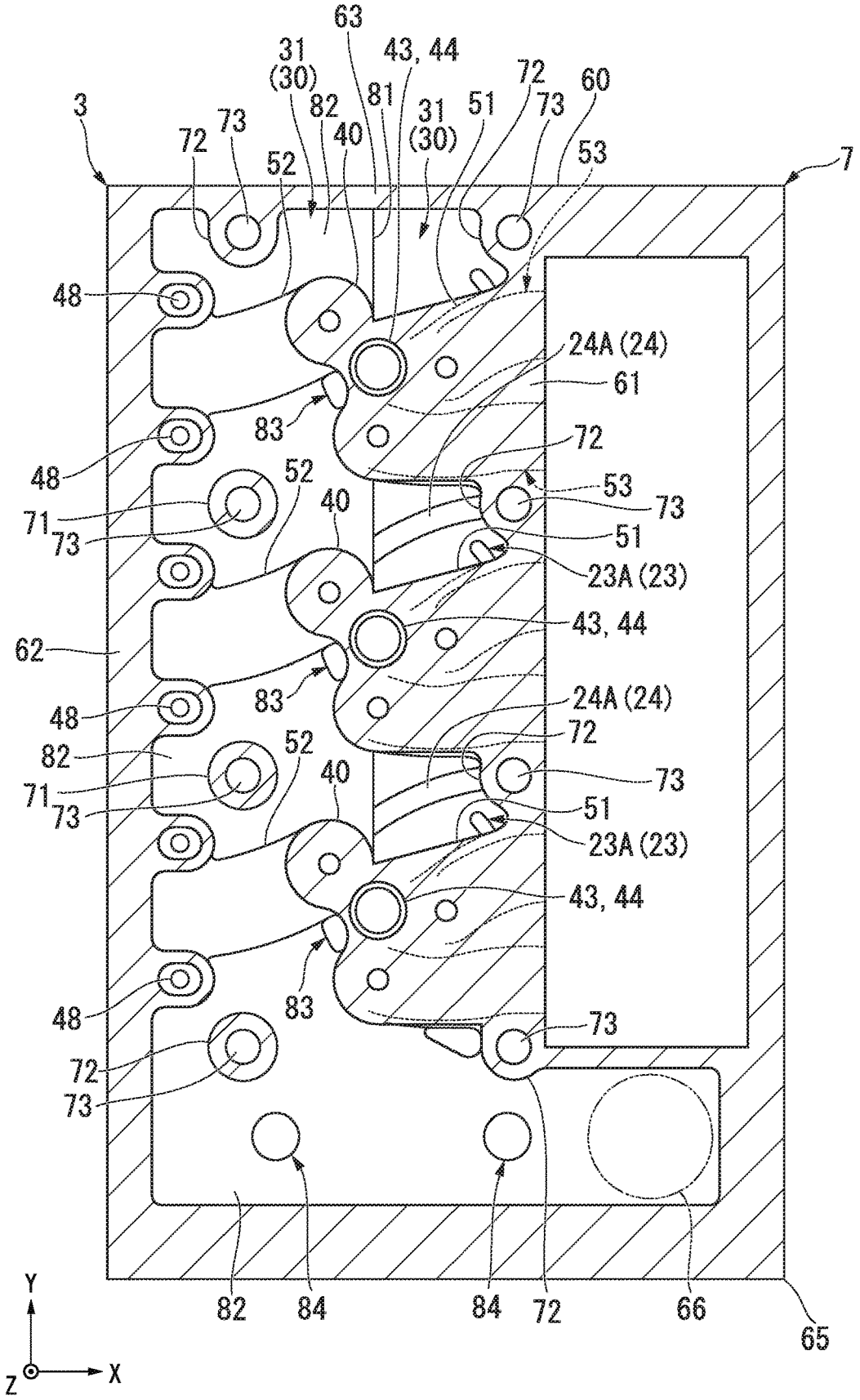
FIG. 6 is a sectional view taken along the line VI-VI of FIG. 1 and FIG. 4.

In this embodiment, as shown in FIGS. 3, 5, and 6, a plurality of (three in the example shown in the drawings) valve-hole forming walls 40 are arranged in a line at a distance from each other in the first orthogonal direction (Y-axis direction) orthogonal to the vertical direction (Z-axis direction), in other words, in the cylinder arranged direction. The plurality of valve-hole forming walls 40 is positioned so as to correspond to each of the plurality of cylinders 11. In this embodiment, two intake valve holes 41 and one exhaust valve hole 42 correspond to one cylinder 11.

<Intake Port Forming Portion>

As shown in FIGS. 1, and 3 to 6, the cylinder head 3 includes an intake port forming portion 51 that is connected to the valve-hole forming wall 40. The intake port forming portion 51 is located on one side (X-axis positive direction side) of the valve-hole forming wall 40 in the second orthogonal direction which is orthogonal to the vertical direction and the first orthogonal direction. The intake port forming portion 51 is integrally formed on a lower surface of the upper deck 22, and is disposed above the lower deck 21 at a distance from the lower deck 21. A space between the lower deck 21 and the intake port forming portion 51 forms the head-side flow space 30.

An intake port 53 that communicates with the intake valve hole 41 is formed in the intake port forming portion 51. The intake port 53 extends from the intake valve hole 41 to one side in the second orthogonal direction. In other words, the intake port 53 is formed so as to suck air from the intake side of the cylinder head 3 which is one side of the second orthogonal direction.

A plurality of (three in the example shown in the drawings) intake port forming portions 51 are arranged in a first orthogonal direction at a distance from each other so as to correspond to each of the plurality of valve-hole forming walls 40. Two intake ports 53 which communicate with each of the two intake valve holes 41 formed in each of the valve-hole forming walls 40 are formed in each of the intake port forming portions 51.

<Exhaust Port Forming Portion>

As shown in FIGS. 4, and 5, the cylinder head 3 includes an exhaust port forming portion 52 that is connected to each of the valve-hole forming walls 40. The exhaust port forming portion 52 is positioned on the other side (X-axis negative direction side) in the second orthogonal direction with respect to the valve-hole forming wall 40. The exhaust port forming portion 52 is disposed above the lower deck 21 and below the upper deck 22 at a distance from the lower deck 21 and the upper deck 22. A space between the lower deck 21 and the exhaust port forming portion 52, and a space between the upper deck 22 and the exhaust port forming portion 52 respectively form the head-side flow space 30.

An exhaust port 54 which communicates with the exhaust valve hole 42 is formed in the exhaust port forming portion 52. The exhaust port 54 extends from the exhaust valve hole 42 to the other side in the second orthogonal direction. In other words, the exhaust port 54 is formed so as to exhaust air to an exhaust side of the cylinder head 3, which is the other side in the second orthogonal direction.

A plurality of (three in the example shown in the drawings) exhaust port forming portions 52 are arranged at a distance from each other in the first orthogonal direction so as to correspond to each of the plurality of valve-hole forming walls 40.

<Outer Peripheral Wall>

As shown in FIGS. 3, 5, and 6, the cylinder head 3 further includes an outer peripheral wall 60 provided on an outer peripheral side of the plurality of valve-hole forming walls 40 described above. The outer peripheral wall 60 extends from the lower deck 21 to the upper deck 22 so as to surround the plurality of valve-hole forming walls 40, and defines the head-side flow space 30 together with the lower deck 21 and the upper deck 22.

On the outer peripheral wall 60, there are two lateral walls 61, 62 and one end wall 63. As shown in FIGS. 4 and 5, the two lateral walls 61, 62 extend in the first orthogonal direction (the Y-axis direction) at the both ends of the cylinder head 3 in the second orthogonal direction (the X-axis direction). The intake port forming portion 51 described above is integrally formed on an intake-side lateral wall 61 located on an intake side (the X-axis positive direction side) of the two lateral walls 61, 62. An intake port 53 passes through the intake-side lateral wall 61. The exhaust port forming portion 52 described above is integrally formed on an exhaust-side lateral wall 62 located on an exhaust side (the X-axis positive direction side) of the two lateral walls 61, 62. An exhaust port 54 passes through the exhaust-side lateral wall 62. Further, a push rod 48 (FIG. 1) described above passes through the exhaust-side lateral wall 62 in the vertical direction. A plurality of push rods 48 are arranged at a distance from each other in the first orthogonal direction.

As shown in FIGS. 3, 5, and 6, the one end wall 63 extends in the second orthogonal direction across first ends of the two lateral walls 61, 62 in the first orthogonal direction. A second end of each of the two lateral walls 61, 62 is open. A cooling water discharge portion 65 is provided on the second end side of the two lateral walls 61, 62 (the end portion on one side of the arrangement direction of the plurality of valve-hole forming walls 40). The cooling water flowing through the head-side flow space 30 is discharged to the cooling water discharge portion 65.

<Bolt-Hole Forming Wall>

As shown in FIGS. 3, 5, and 6, the cylinder head 3 further includes bolt-hole forming walls 71, 72 extending from the lower deck 21 to the upper deck 22. Bolt holes 73 for attaching the cylinder head 3 to the cylinder block 2 are formed in the bolt-hole forming walls 71, 72. Each bolt hole 73 opens into the lower surface 21*b* of the lower deck 21 and the upper surface 22*a* of the upper deck 22. In other words, the bolt hole 73 passes through the cylinder head 3 in the vertical direction thereof. In the present embodiment, one bolt hole 73 is formed in the same bolt-hole forming walls 71, 72.

A plurality of bolt-hole forming walls 71, 72 (four in the example shown in the drawings) are arranged in a circumferential direction of each of valve-hole forming walls 40 so as to surround each of the valve-hole forming walls 40. In addition, the plurality of bolt-hole forming walls 71, 72 (four in the example shown in the drawings) are arranged in the first orthogonal direction on each of the intake side and the exhaust side of the valve-hole forming wall 40 so as to be located on both sides of the same valve-hole forming wall 40 in the first orthogonal direction.

Part of the bolt-hole forming wall 71 (a first bolt-hole forming wall 71) of the plurality of bolt-hole forming walls 71, 72 is positioned at a distance from the outer peripheral wall 60 described above. The first bolt-hole forming wall 71 in the present embodiment is located between two valve-hole forming walls 40 adjacent to each other in the first orthogonal direction on the exhaust side of the valve-hole forming wall 40. The first bolt-hole forming wall 71 is located between the valve-hole forming wall 40 and the exhaust-side lateral wall 62 in the second orthogonal direction. The remaining bolt-hole forming wall 72 (second bolt-hole forming wall 72) is integrally formed on the outer peripheral wall 60.

The valve-hole forming wall 40, the outer peripheral wall 60, and the bolt-hole forming wall 71, 72 described above constitute a wall portion formed between the lower deck 21 and the upper deck 22.

<Cooling Water Introduction Hole>

As shown in FIG. 3, the cooling water introduction hole 23 formed in the lower deck 21 extends in the circumferential direction of a virtual circle VC surrounding the valve-hole forming wall 40 in a plan view. The virtual circle VC in the present embodiment is a circle corresponding to a planar viewed shape of the cylinder bore 11*a* of the cylinder 11. Further, the virtual circle VC is a circle centered on a central hole 43 (fuel injector 44) formed in the valve-hole forming wall 40. The cooling water introduction hole 23 is located outside the virtual circle VC (cylinder bore) in the radial direction. Further, the cooling water introduction hole 23 is positioned at a distance from the valve-hole forming wall 40.

A plurality of cooling water introduction holes 23 (three in the example shown in the drawings) are arranged at a distance from each other in the circumferential direction of the virtual circle VC with respect to the same valve-hole forming wall 40. The cooling water introduction holes 23 formed on the same valve-hole forming wall 40 include an intake-side introduction hole 23A provided adjacent to the intake side of the valve-hole forming wall 40 and an exhaust-side introduction hole 23B provided adjacent to the exhaust side of the valve-hole forming wall 40.

The intake-side introduction hole 23A is located between the valve-hole forming wall 40 and the intake-side lateral wall 61 in the second orthogonal direction. The number of the intake-side introduction holes 23A in the present embodiment is two for one virtual circle VC. The two intake-side introduction holes 23A are displaced toward both sides of the center of the virtual circle VC (the central hole 43, the fuel injector 44) in the first orthogonal direction. For example, the number of intake-side introduction holes 23A may be one, or may be, for example, three or more.

As shown in FIGS. 1 and 3, the intake-side introduction hole 23A is located below the intake port forming portion 51 in a vertical direction. In other words, the intake-side introduction hole 23A is covered by the intake port forming portion 51. However, as illustrated in FIGS. 3 and 5, part of the intake-side introduction hole 23A needs not to be covered by the intake port forming portion 51.

As shown in FIG. 3, the exhaust-side introduction hole 23B is located between the valve-hole forming wall 40 and the exhaust-side lateral wall 62 in the second orthogonal direction. The number of the exhaust-side introduction holes 23B in the present embodiment for one virtual circle VC. The exhaust-side introduction hole 23B is displaced toward the end wall 63 side of the outer peripheral wall 60 (the other side in the arrangement direction of the plurality of valve-hole forming walls 40) with respect to the center of the virtual circle VC in the first orthogonal direction. For example, a plurality of exhaust-side introduction holes 23B may be provided.

As shown in FIGS. 3 and 4, the exhaust-side introduction hole 23B is located below the exhaust port forming portion 52 in the vertical direction. In other words, the exhaust-side introduction hole 23B is covered by the exhaust port forming portion 52. In addition, part of the exhaust-side introduction hole 23B may not be covered by, for example, the exhaust port forming portion 52.

<Rib>

As shown in FIG. 3, the ribs 24 formed on the upper surface 21*a* of the lower deck 21 are provided so as to be arranged in the circumferential direction of the virtual circle VC with respect to the cooling water introduction hole 23. Further, the rib 24 is provided so as to extend in the circumferential direction of the virtual circle VC. In the present embodiment, both ends of the ribs 24 in the extending direction are in contact with the wall portion (the valve-hole forming wall 40, the outer peripheral wall 60, and the bolt-hole forming wall 71, 72). Hereinafter, the ribs 24 of the present embodiment will be described in more detail.

The ribs 24 of the present embodiment include intake-side ribs 24A which are provided on an intake side from the center of the virtual circle VC in the second orthogonal direction (X-axis direction), and exhaust-side ribs 24B which are provided on an exhaust side from the center of the virtual circle VC.

The intake-side ribs 24A extend mainly in the second perpendicular direction from the second bolt-hole forming wall 40 integrally formed on the intake-side lateral wall 61 of the outer peripheral wall 60 to the valve-hole forming wall 40 between the two valve-hole forming walls 72 adjacent in the first orthogonal direction (Y axis direction). In other words, both ends of each intake-side rib 24A in the extending direction are in contact with the valve-hole forming wall 40 and the second bolt-hole forming wall 72. Thus, the intake-side ribs 24A are positioned so as to be arranged in the circumferential direction of each of the virtual circles VC with respect to the two intake-side introduction holes 23A which are located on both sides of the corresponding intake-side rib 24A in the first orthogonal direction.

In the cylinder head 3 of the example shown in the drawings, since the number of the valve-hole forming walls 40 is three, the number of the intake-side ribs 24A is two.

A portion in which a first end of the intake-side rib 24A in the extending direction is in contact with the valve-hole forming wall 40 is located inside the virtual circle VC in the radial direction. For this reason, the intake-side rib 24A extends across the inside and outside of the imaginary circle VC in the radial direction.

In the present embodiment, the first end of the intake-side rib 24A in the extending direction is in contact with the valve-hole forming wall 40 located on the cooling water discharge portion 65 side among the two valve-hole forming walls 40 which are adjacent to each other in the first orthogonal direction as shown in the drawing. For this reason, the intake-side ribs 24A inclines toward the cooling water discharge portion 65 in the first orthogonal direction while directed toward the valve-hole forming wall 40 from the second bolt-hole forming wall 72 in the second orthogonal direction.

In addition, the first end of the intake-side rib 24A in the extending direction may be in contact with the valve-hole forming wall 40 located on the end wall 63 side of the outer peripheral wall 60 among the two valve-hole forming walls 40 which are adjacent to each other in the first orthogonal direction. In addition, a second end of the intake-side rib 24A in the extending direction may be in contact with the intake-side lateral wall 61 instead of the second bolt-hole forming wall 72, for example.

The exhaust-side ribs 24B are located between the valve-hole forming wall 40 and the exhaust-side lateral wall 62 in the second orthogonal direction. The exhaust-side ribs 24B extend mainly in the first orthogonal direction (the arrangement direction of the plurality of valve-hole forming walls 40). Both ends of the exhaust-side rib 24B in the extending direction are in contact with the exhaust-side lateral wall 62 and the bolt-hole forming wall 71, 72.

Specifically, a first end of the exhaust-side rib 24B in the extending direction is in contact with the bolt-hole forming wall 71, 72 located closer to the cooling water discharge portion 65 side than the corresponding valve-hole forming wall 40 in the first orthogonal direction. On the other hand, a second end of the exhaust-side rib 24B in the extending direction is in contact with a portion closer to the end wall 63 side of the outer peripheral wall 60 than the center of the virtual circle VC among the exhaust-side lateral wall 62 in the first orthogonal direction. For this reason, the exhaust-side ribs 24B incline toward the intake side in the second orthogonal direction while directed toward the cooling water discharge portion 65 side from the exhaust-side lateral wall 62 in the first orthogonal direction. Thus, the portion of the exhaust-side rib 24B on the first end side (on the side where the bolt-hole forming wall 71, 72 is present) is positioned so as to be arranged in the circumferential direction of the virtual circle VC with respect to the corresponding exhaust-side introduction hole 23B. Further, a portion of the exhaust-side rib 24B on the second end side (on the side where the exhaust-side lateral wall 62 is present) is positioned so as to be arranged outside the virtual circle VC in the radial direction with respect to the corresponding exhaust side introduction hole 23B.

A plurality of exhaust-side ribs 24B are respectively provided so as to correspond to the plurality of valve-hole forming walls 40. In other words, the number of the exhaust-side ribs 24B corresponds to the number of the valve-hole forming walls 40 (three in the example shown in the drawings).

Further, as shown in FIGS. 1, 3, and 4, each of the exhaust-side ribs 24B is provided below the corresponding exhaust port forming portion 52.

<Head-Side Flow Space>

As shown in FIGS. 1, and 3 to 6, in the cylinder head 3 of the present embodiment, the head-side flow space 30 is partitioned into two partition spaces 31, 32 by the first partition wall 81 (FIG. 3) and the second partition wall 82 (FIGS. 1 and 4).

As shown in FIGS. 1, 3, and 4, the first partition wall 81 partitions the lower portion of the head-side flow space 30 located on the lower deck 21 side in the vertical direction into a space on the intake side and a space on the exhaust side. The first partition wall 81 is formed so as to connect the adjacent valve-hole forming walls 40 to each other and to connect the valve-hole forming walls 40, which are located in the both ends of the plurality of valve-hole forming walls 40 in the arrangement direction, and the outer peripheral wall 60.

As shown in FIGS. 1, 4, and 5, the second partition wall 82 partitions the space on the exhaust side located closer to the exhaust side than the valve-hole forming wall 40 and the first partition wall 81 in the second orthogonal direction (X-axis direction) into a lower portion space including the lower side of the exhaust port forming portion 52 and an upper portion space including the upper side of the exhaust port forming portion 52 in the vertical direction.

The head-side flow space 30 is partitioned by the first partition wall 81 and the second partition wall 82 into a first partition space 31 including the space on the intake side and an upper portion space on an exhaust side, and a second partition space 32 including a lower portion space on an exhaust side.

As shown in FIG. 3, the intake-side introduction port 23A and the intake-side introduction port 24A are located in the space on the intake side of the first partition space 31. On the other hand, an exhaust-side introduction hole 23B and an exhaust-side ribs 24B are located in the second partition space 32. In the present embodiment, the upper portion space (FIG. 5) on the exhaust side of the first partition space 31, and the second partition space 32 (FIG. 3) arc connected to the cooling water discharge portion 65. In other words, the space on the intake side of the first partition space 31 is connected to the cooling water discharge portion 65 via the upper portion space on the exhaust side. Therefore, the cooling water which has flowed into the space on the intake side of the first partition space 31 through the intake-side introduction hole 23A flows through the upper portion space on the exhaust side of the first partition space 31, and is then discharged to the cooling water discharge portion 65. On the other hand, the cooling water that has flowed into the second partition space 32 through the exhaust-side introduction hole 23B is directly discharged to the cooling water discharge portion 65.

Further, as shown in FIGS. 5, and 6, in the second partition wall 82, a first through hole 83 connecting the upper portion space on the exhaust side of the first partition space 31 and the second partition space 32 is formed. The first through hole 83 is formed so as to pass through the second partition wall 82 in the vertical direction. The first through hole 83 is positioned so as to be in contact with each of the plurality of valve-hole forming walls 40. In other words, the number of the first through holes 83 is equal to the number of the valve-hole forming walls 40. By forming the first through hole 83, part of the cooling water that has flowed into the second partition space 32 through the exhaust-side introduction hole 23B flows into the upper portion space on the exhaust side of the first partition space 31 through the first through hole 83.

Further, the first through hole 83 is located adjacent to the exhaust port forming portion 52 in the cooling water discharge portion 65 side in the first orthogonal direction (Y-axis direction). Accordingly, the cooling water flowing into the upper portion space on the exhaust side of the first partition space 31 from the second partition space 32 (FIG. 3) through the first through hole 83 is prevented from flowing in the direction away from the cooling water discharge portion 65 in the first orthogonal direction by the exhaust port forming portion 52. In other words, the cooling water flows along the exhaust port forming portion 52 and the valve-hole forming wall 40. Then, a flow directed toward the second orthogonal direction of the cooling water flowing into the upper portion space on the exhaust side of the first partition space 31 from the second partition space 32 through the first through hole 83 can be directed toward the first orthogonal direction by the exhaust port forming portion 52 so as to direct toward the cooling water discharge portion 65.

Further, the second partition wall 82 of the present embodiment extends into the cooling water discharge portion 65. In other words, the second partition wall 82 also partitions an internal space of the cooling water discharge portion 65 in the vertical direction. A second through hole 84 connecting two spaces in the cooling water discharge portion 65 is formed in a portion of the second partition wall 82 located in the cooling water discharge portion 65. Thus, it is possible to allow the cooling water flowing into the cooling water discharge portion 65 from the head-side flow space 30 to flow through both of the two spaces in the cooling water discharge portion 65. Specifically, the cooling water flowing into a lower partition space of the second partition wall 82 in the cooling water discharge portion 65 from the second partition space 32 flows to an upper partition space of the second partition wall 82 in the cooling water discharge portion 65 through the second through hole 84.

In the present embodiment, the cooling water flowing into the cooling water discharge portion 65 is discharged to the outside of the cooling water discharge portion 65 through a discharge port 66 formed in the upper portion of the cooling water discharge portion 65, but the present invention is not limited thereto.

As shown in FIGS. 1, 2, and 4, a rocker housing 6 is integrally formed in the cylinder head 3 of the present embodiment. The rocker housing 6 is formed so as to extend upward (in the positive direction of the Z-axis) of the cylinder head 3 at the peripheral edge of the upper surface 22*a* of the upper deck 22 (the cylinder head 3), and surrounds the rocker arm 47 and the like provided in the upper surface 22*a* of the upper deck 22. Further, as shown in FIGS. 1, 2, and 4 to 6, an intake manifold 7 is integrally formed with the cylinder head 3 of the present embodiment. The intake manifold 7 is connected to an intake-side lateral wall 61 of the cylinder head 3. The intake manifold 7 extends in the first orthogonal direction so as to be communicated with each of the plurality of intake ports 53 in which an internal space is arranged in the first orthogonal direction.

<Operation and Effects>

In the cylinder head 3 of the present embodiment, as shown in FIG. 3, the exhaust-side ribs 24B are formed so as to be arranged in the circumferential direction of the virtual circle VC with respect to the exhaust-side introduction holes 23B. Therefore, the cooling water flowing into the second partition space 32 of the head-side flow space 30 through the exhaust-side introduction hole 23B is guided by the exhaust-side rib 24B and easily flows in the circumferential direction of the virtual circle VC around the valve-hole forming wall 40. As the cooling water flows in this way, the valve-hole forming wall 40 is cooled down.

Further, the exhaust-side rib 24B extends in the first orthogonal direction (the arrangement direction of the plurality of valve-hole forming walls 40). Therefore, the cooling water that has flowed into the second partition space 32 from the exhaust-side introduction hole 23B is guided by the exhaust-side rib 24B and easily flows in the first orthogonal direction. As a result, the cooling water flowing through the second partition space 32 easily flows toward the cooling water discharge part 65. The cooling water flowing in this way passes a lower side of the exhaust port forming portion 52, thereby cooling the exhaust port forming portion 52.

Further, as shown in FIGS. 5 and 6, the first through hole 83 formed in the second partition wall 82 and connecting the first partition space 31 and the second partition space 32 in the vertical direction is located adjacent to the cooling water discharge portion 65 side of the exhaust port forming portion 52 in the first orthogonal direction. Therefore, the cooling water flowing into the upper portion space on the exhaust side of the first partition space 31 from the second partition space 32 through the first through hole 83 easily flows toward the cooling water discharge portion 65 in the first orthogonal direction by the exhaust port forming portion 52. The cooling water flowing in this way passes an upper side of the exhaust port forming portion 52, thereby cooling the exhaust port forming portion 52.

In addition, in the cylinder head 3 of the present embodiment, as shown in FIG. 3, the intake-side ribs 24A are formed so as to be arranged in the circumferential direction of the virtual circle VC with respect to the intake-side introduction holes 23A. Therefore, the cooling water flowing into the space on the intake side of the first partition space 31 in the head-side flow space 30 through the intake-side introduction hole 23A easily flows in the circumferential direction of the virtual circle VC around the valve-hole forming wall 40. As the cooling water flows in this way, the valve-hole forming wall 40 is cooled.

As shown in FIGS. 3, 5, and 6, the intake-side rib 24A extends from the intake-side lateral wall 61 toward the valve-hole forming wall 40. Therefore, the cooling water that has flowed into the space on the intake side from the intake-side introduction hole 23A easily flows toward the upper portion space on the exhaust side of the first partition space 31 along the intake-side rib 24A.

Then, the cooling water that has entered into the upper portion space on the exhaust side from the space on the intake side of the first partition space 31 flows toward the cooling water exhaust portion 65 side along the first orthogonal direction, along with the cooling water that has flowed into the upper portion space on the exhaust side of the first partition space 31 through the first through hole 83, by the flow of the cooling water that has entered the upper portion space on the exhaust side from the first through hole 83. The temperature of the cooling water that has entered the upper portion space on the exhaust side from the space on the intake side is lower than the temperature of the cooling water that has entered the upper portion space on the exhaust side from the first through hole 83. Thus, it is possible to efficiently cool the exhaust port forming portion 52.

As described above, according to the cylinder head 3 of the present embodiment and the engine 1 provided the same, the ribs 24 are formed so as to be arranged in the circumferential direction of the virtual circle VC (the cylinder bore 11*a*) with respect to the cooling water introduction hole 23 in the upper surface 21*a* of the lower deck 21. Thus, it is possible to enhance the rigidity of the portion around the virtual circle VC of the lower deck 21. In particular, it is possible to enhance the rigidity of the portion around the cooling water introduction hole 23 which is reduced in rigidity by forming the cooling water introduction hole 23 in the lower deck 21. Therefore, even if the lower deck 21 is formed thin, it is possible to secure the surface pressure of the lower deck 21 (in particular, a portion corresponding to a periphery of the cylinder bore 11*a*) pressed against the cylinder block 2 in a state in which the cylinder head 3 is attached to the cylinder block 2 so that the lower deck 21 is pressed against the cylinder block 2 by the bolt.

Further, according to the cylinder head 3 and the engine 1 of the present embodiment, the ribs 24 extend in the circumferential direction of the virtual circle VC (cylinder bore 11*a*). Therefore, the cooling water easily flows in the circumferential direction of the virtual circle VC around the valve-hole forming wall 40 in the head-side flow space 30. As the result, the valve-hole forming wall 40 can be efficiently cooled by the cooling water.

Further, according to the cylinder head 3 and the engine 1 of the present embodiment, the both ends of each of the ribs 24 in the extending direction is in contact with the wall portion (the valve-hole forming wall 40, the outer peripheral wall 60, and the bolt-hole forming wall 71, 72) having a high rigidity. Thus, the rigidity of the portion around the virtual circle VC of the lower deck 21 can be further enhanced.

According to the cylinder head 3 and the engine 1 of the present embodiment, the intake-side ribs 24A extend across an inside and an outside in the radial direction of the virtual circle VC (cylinder bore 11*a*). Thus, it is possible to enhance the rigidity of the portion extending across the inside and outside of the virtual circle VC in the lower deck 21. Therefore, even if the lower deck 21 is formed thin, it is possible to further increase the surface pressure of the lower deck 21 (in particular, the portion corresponding to a periphery of the cylinder bore 11*a*) which is pressed against the cylinder block 2.

Further, according to the cylinder head 3 and the engine 1 of the present embodiment, the cooling water discharge portion 65 is provided on an end portion at one side in the arrangement direction of the plurality of valve-hole forming walls 40. Further, the plurality of exhaust-side ribs 24B are provided so as to respectively correspond to the plurality of valve-hole forming walls 40, and extend in the arrangement direction of each of the plurality of valve-hole forming walls 40. Therefore, the cooling water flowing through the head-side flow space 30 (in particular, the second partition space 32) is guided by the exhaust-side ribs 24B and easily flows in the arrangement direction of the plurality of valve-hole forming walls 40. Further, the cooling water flowing through the head-side flow space 30 easily flows toward the cooling water discharge portion 65.

Further, according to the cylinder head 3 and the engine 1 of the present embodiment, the intake-side ribs 24A extend from the intake-side lateral wall 61 toward the valve-hole forming wall 40. Therefore, the cooling water that has flowed into the space on the intake side of the first partition space 31 from the intake-side introduction hole 23A is guided by the intake-side ribs 24A and easily flows toward the upper portion space on the exhaust side from the space on the intake side of the first partition space 31.

Further, according to the cylinder head 3 and the engine 1 of the present embodiment, the first through hole 83 formed in the second partition wall 82 and connecting the first partition space 31 and the second partition space 32 in the vertical direction is positioned adjacent to the cooling water discharge portion 65 side of the exhaust port forming portion 52 in the first orthogonal direction. Therefore, the cooling water that has flowed into the upper portion space on the exhaust side of the first partition space 31 from the second partition space 32 through the first through hole 83 easily flows toward the cooling water discharge portion 65 in the first orthogonal direction by the exhaust port forming portion 52.

As a result, the cooling water can smoothly flow from the cooling water introduction hole 23 (the intake-side introduction hole 23A and the exhaust-side introduction hole 23B) to the cooling water discharge portion 65 in the head-side flow space 30. Accordingly, it is possible to efficiently cool the valve-hole forming wall 40 and the exhaust port forming portion 52 by the cooling water flowing through the head-side flow space 30.

Other Embodiments

Although embodiments of the present invention have been described as above, the present invention is not limited thereto, and can be appropriately changed without departing from the technical idea of the present invention.

In the cylinder head of the present invention, for example, only one end of the both ends of the rib in the extending direction formed in the lower deck may be in contact with the wall portion (the valve-hole forming wall, the outer peripheral wall, and the bolt-hole forming wall). In this case as well, it is possible to enhance the rigidity of the portion around the virtual circle of the lower deck.

In addition, in the cylinder head of the present invention, the ribs do not have to come into contact with, for example, the wall portion.

In addition, the number of cylinders in the present invention engine may be, for example, one. In other words, the number of the valve-hole forming walls in the cylinder head of the present invention may be, for example, one.

The engine of the present invention may be applied to any work vehicle such as a dump truck, a hydraulic excavator, a bulldozer, an engine type forklift, or the like.

EXPLANATION OF REFERENCE SIGN

1: Engine,
2: Cylinder block,
3: Cylinder head,
11: Cylinder,
11*a:* Cylinder bore,
21: Lower deck,
21*a:* Upper surface,
21*b:* Lower surface,
22: Upper deck,
23: Cooling water introduction hole,
23A: Intake-side introduction hole,
23B: Exhaust-side introduction hole,
24: Rib,
24A: Intake-side rib,
24B: Exhaust-side rib,
30: lead-side flow space (Cooling water flow space),
31: First partition space,
32: Second partition space,
40: Valve-hole forming wall,
41: Intake valve hole,
42: Exhaust valve hole,
43: Central hole,
44: Fuel injector,
51: Intake port forming portion,
52: Exhaust port forming portion,
53: Intake port,
54: Exhaust port,
60: Outer peripheral wall,
61, 62: Lateral wall,
63: End wall,
65: Cooling water discharge portion,
71, 72: Bolt-hole forming wall,
81: First partition wall,
82: Second partition wall,
83: First through hole,
VC: Virtual circle

The invention claimed is:

1. A cylinder head comprising:

a lower deck;

an upper deck that is provided above the lower deck so as to face the lower deck and that defines a cooling water flow space between the lower deck and the upper deck;

a wall portion that is formed between the lower deck and the upper deck and includes a plurality of valve-hole forming walls, an outer peripheral wall, and a plurality of bolt-hole forming walls, wherein the plurality of valve-hole forming walls form an intake valve hole and an exhaust valve hole which are opened into a lower surface of the lower deck and are arranged at a distance from each other in a line in an orthogonal direction which is orthogonal to a vertical direction, the outer peripheral wall is provided on an outer peripheral side of the plurality of valve-hole forming walls so as to surround the plurality of valve-hole forming walls, and the plurality of bolt-hole forming walls form at least one bolt hole configured to attach the cylinder head to the cylinder block and are arranged in a circumferential direction of each valve-hole forming wall so as to surround each valve-hole forming walls, wherein the lower deck includes:

a cooling water introduction hole that passes through the lower deck in a vertical direction so as to extend in a circumferential direction of a virtual circle surrounding at least one of the valve-hole forming walls when seen from a plan view; and a rib that projects from an upper surface of the lower deck so as to extend in the circumferential direction, wherein the plurality of bolt-hole forming walls includes a first bolt-hole forming wall and a second bolt-hole forming wall, the first bolt-hole forming wall is positioned at a distance from the outer peripheral wall and is located between the valve-hole forming wall and the outer peripheral wall, and the second bolt-hole forming wall is integrally formed on the outer peripheral wall, and wherein the rib includes intake-side ribs that are provided on an intake side from the center of the virtual circle, and exhaust-side ribs that are provided on an exhaust side from the center of the virtual circle, the intake-side ribs are located between the two adjacent valve-hole forming walls and extend from the second bolt-hole forming wall to at least one of the valve-hole forming walls, and the exhaust-side ribs are located between one of the valve-hole forming walls and the outer peripheral wall and extends in an arrangement direction of the plurality of valve-hole forming walls.

2. The cylinder head according to claim 1, wherein a central hole through which a fuel injector is inserted in the vertical direction is formed on the valve-hole forming wall, and the virtual circle is a circle centered on the central hole when seen in a plan view.

3. The cylinder head according to claim 1, wherein at least one end of both ends of the rib in an extending direction is in contact with the wall portion.

4. The cylinder head according to claim 1, wherein the rib extends across an inside and an outside of the virtual circle in the radial direction.

5. The cylinder head according to claim 1, wherein a cooling water discharge portion that is configured to discharge a cooling water flowing through the cooling water flow space is provided at an end portion at one side in an arranged direction of the plurality of the valve-hole forming walls.

6. The cylinder head according to claim 1, comprising an exhaust port forming portion that is connected to the valve-hole forming wall and forms an exhaust port communicating with the exhaust valve hole, wherein the exhaust port forming portion is disposed at a distance from the lower deck and the upper deck above the lower deck and below the upper deck, and wherein the rib is provided below the exhaust port forming portion.

7. An engine comprising:

a cylinder head according to claim 1; and a cylinder block having a cylinder bore forming a cylinder and covered by the cylinder head from above, wherein the virtual circle is a circle corresponding to a planar view shape of the cylinder bore.

8. The cylinder head according to claim 2, wherein at least one end of both ends of the rib in an extending direction is in contact with the wall portion.

9. The cylinder head according to claim 2, wherein the rib extends across an inside and an outside of the virtual circle in the radial direction.

10. The cylinder head according to claim 3, wherein the rib extends across an inside and an outside of the virtual circle in the radial direction.

11. The cylinder head according to claim 2, wherein a cooling water discharge portion that is configured to discharge a cooling water flowing through the cooling water flow space is provided at an end portion at one side in an arranged direction of the plurality of the valve-hole forming walls.

12. The cylinder head according to claim 3, wherein a cooling water discharge portion that is configured to discharge a cooling water flowing through the cooling water flow space is provided at an end portion at one side in an arranged direction of the plurality of the valve-hole forming walls.

13. The cylinder head according to claim 2, comprising an exhaust port forming portion that is connected to the valve-hole forming wall and forms an exhaust port communicating with the exhaust valve hole, wherein the exhaust port forming portion is disposed at a distance from the lower deck and the upper deck above the lower deck and below the upper deck, and wherein the rib is provided below the exhaust port forming portion.

14. The cylinder head according to claim 3, comprising an exhaust port forming portion that is connected to the valve-hole forming wall and forms an exhaust port communicating with the exhaust valve hole, wherein the exhaust port forming portion is disposed at a distance from the lower deck and the upper deck above the lower deck and below the upper deck, and wherein the rib is provided below the exhaust port forming portion.

15. An engine comprising:

a cylinder head according to claim 2; and a cylinder block having a cylinder bore forming a cylinder and covered by the cylinder head from above, wherein the virtual circle is a circle corresponding to a planar view shape of the cylinder bore.

16. An engine comprising:

a cylinder head according to claim 3; and a cylinder block having a cylinder bore forming a cylinder and covered by the cylinder head from above, wherein the virtual circle is a circle corresponding to a planar view shape of the cylinder bore.

17. The cylinder head according to claim 3, both ends of each intake-side rib in the extending direction are in contact with the valve-hole forming wall and the second bolt-hole forming wall.

18. The cylinder head according to claim 3, both ends of the at least one of the exhaust-side ribs in the extending direction are in contact with the outer peripheral wall and the bolt-hole forming walls.

* * * * *